United States Patent [19]

Matsuura

[11] 4,033,111

[45] July 5, 1977

[54] ELECTRONIC WATCH HAVING ANTIMAGNETIC CHARACTERISTIC

[75] Inventor: Eiichi Matsuura, Chiba, Japan

[73] Assignee: Kabushiki Kaisha Daini Seikosha, Japan

[22] Filed: Dec. 19, 1975

[21] Appl. No.: 642,336

[30] Foreign Application Priority Data

Dec. 23, 1974 Japan ..... 502640[U]

[52] U.S. Cl. ..... 58/106.5; 58/55; 310/256

[51] Int. Cl.[2] ..... G04B 43/00

[58] Field of Search ..... 310/86, 85, 89, 40 MM, 310/162, 154, 104, 190, 256; 174/35 R; 336/84 M; 58/106.5, 55

[56] References Cited

UNITED STATES PATENTS

| | | | |
|---|---|---|---|
| 849,292 | 4/1907 | Wall et al. | 58/106.5 |
| 1,247,470 | 11/1917 | Turney | 58/106.5 |
| 1,377,229 | 5/1921 | Tanner | 310/190 |
| 2,579,318 | 12/1951 | Hershberger | 310/190 |
| 3,528,703 | 11/1970 | Walton | 58/23 R |

OTHER PUBLICATIONS

Motor Shields, Data Sheet No. 139, Magnetic Shield Division, Perfection Mica Co., 1322 N. Elston Ave., Chicago 22, Ill., May 5, 1958, (cl. 310–85).

*Primary Examiner*—Ulysses Weldon
*Attorney, Agent, or Firm*—Robert E. Burns; Emmanuel J. Lobato; Bruce L. Adams

[57] ABSTRACT

In an electronic watch powered by a battery, magnetic shield members made of an antimagnetic material are disposed in a watch movement to prevent the magnetization of the watch movement under the influence of a magnetic field outside of the watch, whereby watch hands continuously operate to indicate a correct time. The watch movement includes a bridge and a base plate, and the magnetic shield members are respectively mounted in a recess in the base plate and carried by the bridge so as not to contribute to a thickness of the watch movement.

3 Claims, 5 Drawing Figures

FIG. 1
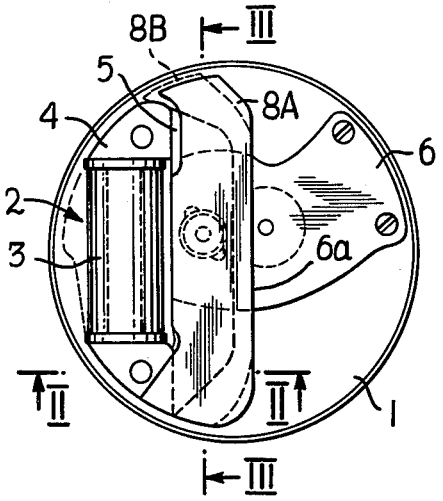
FIG. 2
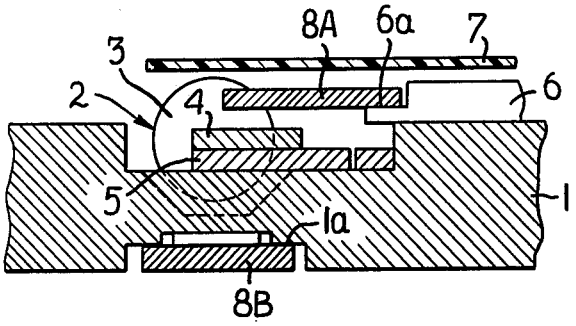
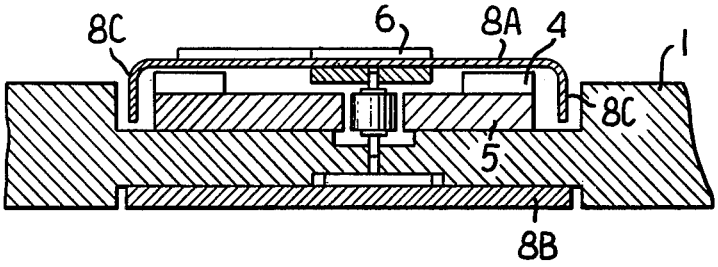
FIG. 3
FIG. 4
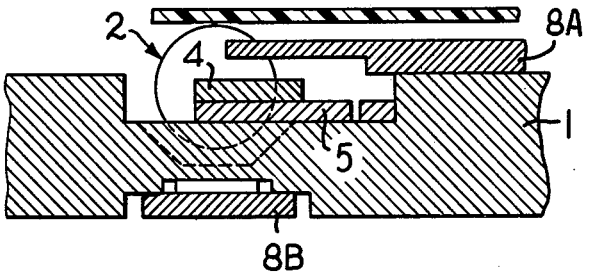
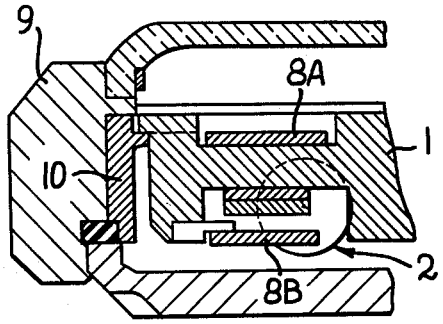
FIG. 5

ELECTRONIC WATCH HAVING ANTIMAGNETIC CHARACTERISTIC

BACKGROUND OF THE INVENTION

This invention relates to an electronic watch powered by a battery, and more particularly to a battery-powerd electronic watch having an antimagnetic characteristic where a watch movement is prevented from magnetizing by means of magnetic shield members which are made of an antimagnetic material and disposed within the watch movement.

Conventionally, it is known for shielding an electric or electronic watch from magnetization by a magnetic flux outside of the watch that a case body of a watch case which serves as a back cover and a case band is made of an antimagnetic material or that a magnetization resistant means made of the antimagnetic material is interposed between the watch movement and the watch case. That is, the magnetization resistant means is interposed between a watch dial and the watch movement or between the back cover and the watch movement. Further, it is proposed that a case ring for holding the watch movement is made of the antimagnetic material. However, in the former case, the external appearance of the watch is restricted from a designing point of view. While, in the later case, the overall thickness of the watch becomes too thick because of the interposed means. In this way, the conventional manner mentioned above is not preferable for small-sized watches especially required to have an aesthetic appearance. Further, the assemble or disassemble operation for the conventional antimagnetic watch is very difficult.

SUMMARY OF THE INVENTION

The present invention aims to overcome above-mentioned drawbacks and to provide a small-sized antimagnetic watch powered by a battery where watch hands and the movement precisely operate without magnetizing by means of a magnetic shield member disposed within the watch movement.

An object of the present invention is to provide an electronic watch including an electromechanical transducer driven by receiving a precise time standard signal where the electromechanical transducer is prevented from magnetization under the influence field outside of the watch by means of a magnetic shield member made of an antimagnetic material, so that watch hands are prevented from stopping or incorrectly operating.

Another object of the invention is to provide a small-sized electronic watch having an antimagnetic characteristic where the magnetic shield member is disposed in a watch movement.

Further object of the invention is to provide an antimagnetic watch in a small size in which the magnetic shield member is secured to the watch movement by means of a screw or an adhesive, whereby assembling of the watch movement having the shield member into a watch case or disassembling said watch movement from the watch case becomes easy.

BRIEF DESCRIPTION OF THE INVENTION

FIG. 1 is a plane view showing an embodiment of an antimagnetic watch according to present invention;

FIG. 2 is a sectional view taken on line II—II in FIG. 1;

FIG. 3 is a sectional view taken on line III—III in FIG. 1;

FIG. 4 is a sectional view of another embodiment of the present invention where a bridge is combined with a magnetic shield means in FIG. 1; and FIG. 5 is a sectional view of another embodiment where the watch movement of the present invention is held by a case ring made of an antimagnetic material for serving as a magnetization resistant means.

DETAILED DESCRIPTION OF THE INVENTION

The present invention will be fully described by way of the embodiment in connection with the accompanying drawings.

In FIG. 1 showing a plane view of the electronic watch according to the present invention and FIG. 2 showing a sectional view taken on line II—II in FIG. 1, 1 is a base plate of a watch movement, and 2 is an electromechanical transducer which is driven by an electric pulse for acting as a step motor. 3 is a driving coil, 4 a magnetic core and 5 a stator of the electromechanical transducer 2. 6 is a bridge for supporting a rotor shaft of a rotor surrounded by the stator. 7 is a circuit board mounted to the watch movement by means of a screw. 8A and 8B are an upper and a lower shield members which together comprise shielding means for shielding the transducer 2 from magnetic fields external to the watch, and which are disposed so as to cover upper and lower surfaces of the electromechanical transducer 2. The magnetic shield members are respectively fixed to a step portion 6A of the bridge 6 and to a recess 1*a* of the base plate 1 by means of the screw or an adhesive within the watch movement.

In the movement constructed as mentioned above, upper and lower surfaces of the electromechanical transducer 2 are shielded by magnetic shield members 8A and 8B. The operation of the electromechanical transducer 2 is correct and stable in case the watch is under the influence of the magnetic field formed by an intensive magnetic flux produced from electronic apparatuses other than the watch since magnetic shield members prevent the induction of the magnetic flux into the electromechanical transducer to avoid a magnetic induction into the electromechanical transducer in the watch movement and to make a magnetic circuit thereof stable therein, whereby an abrupt stop of the watch hands and incorrect operation thereof are not caused.

In FIG. 3 showing a sectional view taken on line III—III in FIG. 1, the upper magnetic shield member 8A is provided at both ends with bent portions 8C in order to increase the effect of magnetic shield. The each bent portion 8C of the upper magnetic shield member 8A serves to shield corresponding side portion of the electromechanical transducer 2 from magnetizing by partially peripherally surrounding the same, so that a magnetic line of force passing through the electromechanical transducer is remarkably decreased.

Referring to FIG. 4, the upper magnetic shield member 8A is combined with the bridge 6 so as to be formed as one body and is made of a high antimagnetic material, for example, a permalloy or a supermalloy. In this way, since the upper magnetic shield member and the bridge are unified, the area of magnetic path of the upper magnetic shield member 8A is so large that the effectiveness of the magnetic shield is further increased.

In FIG. 5, case ring 10 is also made of the antimagnetic material to increase the effect of a magnetization resistance. The case ring 10 serves to hold the watch movement in which said magnetic shield members are disposed for shielding the electromechanical transducer. In the construction where the watch movement of the present invention is held by the case ring made of the antimagnetic material, the effect of the magnetic shield is further increased.

As mentioned above, according to the present invention, it is possible to obtain the small-sized electronic watch having antimagnetic characteristic since the magnetic shield members disposed within the watch movement shield the watch movement from the magnetization under the influence of the magnetic field outside of the watch. Further, the hands of the watch including the present invention correctly operate without stopping or an incorrrect indication of a time.

What is claimed is:

1. In an electronic watch of the type having a watch movement including a base plate having a pair of opposed major surfaces, an electromechanical transducer mounted on a first of said major surfaces and including a rotor operable to rotate by energization of said transducer, means defining a bridge structure a distance above said first major surface wherein a portion of said bridge structure comprises mounting means mounting said rotor for rotation, the improvement which comprises: shielding means defining magnetic shields above and below said transducer for shielding the same from magnetic fields external to the watch; said shielding means comprising a first plate-like portion of antimagnetic material carried by said bridge structure at substantially the same distance from said base plate as said bridge structure and overlying a portion of said electromechanical transducer, and a second plate-like portion of antimagnetic material disposed at the second major surface of said base plate and underlying a portion of said transducer, said second major surface having a sufficiently deep recess therein for receiving said second plate-like portion of said shielding means so that said second plate-like portion does not extend above said second major surface, said first and said second plate-like portions respectively overlying and underlying said electro-mechanical transducer sufficiently to effectively shield said transducer from magnetic fields external to the watch, and said first and second plate-like portions being spaced a distance not exceeding a distance between said bridge structure and said second major surface whereby said shielding means does not contribute to a thickness of the watch movement.

2. In an electronic watch according to claim 1, wherein said first plate-like portion includes a peripheral edge portion turned downwardly toward said base plate to partially peripherally surround said transducer.

3. In an electronic watch according to claim 1, wherein said means defining a bridge structure is made of antimagnetic material and said bridge structure comprises said first plate-like portion of said shielding means.

* * * * *